US010138567B2

(12) United States Patent
Chen

(10) Patent No.: US 10,138,567 B2
(45) Date of Patent: Nov. 27, 2018

(54) APPARATUS AND METHOD FOR IONIC LIQUID ELECTROPLATING

(71) Applicant: United Technologies Corporation, Farmington, CT (US)

(72) Inventor: Lei Chen, South Windsor, CT (US)

(73) Assignee: United Technologies Corporation, Farmington, CT (US)

( * ) Notice: Subject to any disclaimer, the term of this patent is extended or adjusted under 35 U.S.C. 154(b) by 128 days.

(21) Appl. No.: 15/265,693

(22) Filed: Sep. 14, 2016

(65) Prior Publication Data

US 2017/0002478 A1 Jan. 5, 2017

Related U.S. Application Data

(62) Division of application No. 14/510,948, filed on Oct. 9, 2014.

(Continued)

(51) Int. Cl.

| | |
|---|---|
| ***C25D 3/42*** | (2006.01) |
| ***C25D 3/44*** | (2006.01) |
| ***C25D 3/66*** | (2006.01) |
| ***C25D 5/36*** | (2006.01) |
| ***C25D 5/40*** | (2006.01) |
| ***C25D 5/42*** | (2006.01) |
| ***C25D 5/44*** | (2006.01) |

(Continued)

(52) U.S. Cl.

CPC ..... *C25D 21/06* (2013.01); *C23C 18/54* (2013.01); *C25D 3/42* (2013.01); *C25D 3/44* (2013.01); *C25D 3/665* (2013.01); *C25D 5/36* (2013.01); *C25D 5/40* (2013.01); *C25D 5/42* (2013.01); *C25D 5/44* (2013.01); *C25D 17/002* (2013.01); *C25D 17/10* (2013.01); *C25D 21/10* (2013.01); *C25F 3/04* (2013.01); *C25F 3/06* (2013.01); *C25F 3/08* (2013.01)

(58) Field of Classification Search

CPC .... C23C 8/54; C25D 3/42; C25D 3/44; C25D 3/665; C25D 5/36; C25D 5/40; C25D 5/42; C25D 5/44; C25D 17/002; C25D 17/10; C25D 21/06; C25D 21/10; C25F 3/04; C25F 3/06; C25F 3/08

See application file for complete search history.

(56) References Cited

U.S. PATENT DOCUMENTS 4,126,483 A 11/1978 Danakowski et al.
4,126,523 A * 11/1978 Wong ..... C25D 3/44 205/212

(Continued)

OTHER PUBLICATIONS

Li, J. et al. "Complex Chemistry & the Electroless Copper Plating Process," Plating & Surface Finish. Feb. 2004.

*Primary Examiner* — Louis J Rufo
(74) *Attorney, Agent, or Firm* — Kinney & Lange, P.A.

(57) ABSTRACT

An electroplating apparatus includes a container containing plural portions and an ionic liquid plating solution that is capable of flowing therebetween. The plural portions include at least a first portion containing a counter electrode that includes coating donor material and a second portion that includes a workpiece. A porous scrubber separating the first and second portions has a plurality of metallic outer surfaces in contact with the ionic liquid plating solution. Coating, repair, and regeneration methods using an ionic liquid plating solution are also described.

14 Claims, 5 Drawing Sheets

Related U.S. Application Data

(60) Provisional application No. 61/890,639, filed on Oct. 14, 2013.

(51) Int. Cl.

| | |
|---|---|
| ***C25F 3/04*** | (2006.01) |
| ***C25F 3/06*** | (2006.01) |
| ***C25F 3/08*** | (2006.01) |
| ***C23C 18/54*** | (2006.01) |
| ***C25D 17/00*** | (2006.01) |
| ***C25D 17/10*** | (2006.01) |
| ***C25D 21/06*** | (2006.01) |
| ***C25D 21/10*** | (2006.01) |

(56) References Cited

U.S. PATENT DOCUMENTS

| | | | | |
|---|---|---|---|---|
| 4,269,625 | A | 5/1981 | Molenaar | |
| 5,601,695 | A | 2/1997 | Muranushi | |
| 6,881,321 | B2 | 4/2005 | Wu | |
| 8,784,618 | B2 * | 7/2014 | Arvin | C25D 5/04 204/230.7 |
| 2002/0100694 | A1 | 8/2002 | Morin et al. | |
| 2007/0092739 | A1 * | 4/2007 | Steele | C25D 7/00 428/450 |
| 2012/0043216 | A1 | 2/2012 | Arvin et al. | |
| 2013/0075271 | A1 * | 3/2013 | Yu | C25D 3/665 205/210 |
| 2013/0168258 | A1 | 7/2013 | Nakano | |
| 2013/0292255 | A1 | 11/2013 | Inoue | |
| 2014/0205856 | A1 * | 7/2014 | Jiang | C25D 5/14 428/650 |
| 2014/0216940 | A1 | 8/2014 | Wang | |

* cited by examiner

APPARATUS AND METHOD FOR IONIC LIQUID ELECTROPLATING

CROSS-REFERENCE TO RELATED APPLICATION

This application is a divisional of U.S. application Ser. No. 14/510,948 filed Oct. 9, 2014 for "APPARATUS AND METHOD FOR IONIC LIQUID ELECTROPLATING" by Lei Chen which claims priority under 35 U.S.C. § 119(e) to U.S. Provisional Patent Application Ser. No. 61/890,639 entitled "APPARATUS AND METHOD FOR IONIC LIQUID ELECTROPLATING" and filed on Oct. 14, 2013, both of which are hereby incorporated by reference in their entirety.

BACKGROUND

The described subject matter relates generally to ionic liquids and more specifically to cleaning and regeneration of ionic liquids used for electroplating.

Pure aluminum forms a protective oxide film when exposed to oxidants such as air or water, resulting in a passivated surface that is resistant to corrosion. Aluminum alloys, and in particular, and high strength aluminum alloys are prone to localized corrosion. Similar to aluminum cladding, a pure aluminum surface layer can be used to protect Al alloys from corrosion. Electroplating of aluminum works well with complex geometries that would be impossible to be cladded due to line-of-sight and other process challenges. The corrosion resistance of pure aluminum surfaces can be further enhanced by passivation using a conversion coating treatment. In addition to coating high-strength aluminum alloys, electroplated aluminum has also been considered as a leading candidate to replace cadmium coatings on structural steels.

It is extremely difficult to electrolytically deposit aluminum and certain other metals from acidic aqueous solutions. The electronegativity of water relative to aluminum and certain other metals can result in unwanted formation of hydrogen in the plating bath. Al electroplating in ionic liquids have been demonstrated to address these issues on a wide range of metallic substrates.

Substrate pre-treatment has been shown to improve adhesion of the aluminum coating layer. Pre-treatment generally includes degreasing, cleaning, and activation. For reactive substrates such as aluminum alloys, a sacrificial displacement layer such as a zinc immersion coating can be deposited onto cleaned surfaces of the substrate. This can be done to inhibit surface formation of aluminum oxides and prevent subsequent unintended electrodeposition of aluminum coating material on surface oxides versus the alloy substrate. A zinc immersion coating can be deposited via an exchange reaction between zincate ions and the reactive metallic substrates. Alternatively, a displacement layer can be fully or partially etched in the same plating bath to further adjust the bonding strength of the coating.

Partial dissolution of sacrificial immersion coatings can occur spontaneously in conventional aqueous acidic plating baths. However, a number of ionic liquids suitable for electroplating can be extremely water-sensitive. Thus it is desirable to electrolytically remove (e.g., etch) the sacrificial immersion coating in the same or similar ionic liquid plating bath to prevent water contamination. At the same time, the electrolytic etching can result in rapid accumulation of contaminants in the ionic liquid plating solution. These contaminants can include byproducts of the sacrificial displacement layer. Elevated contaminant levels in the ionic liquid can affect the electroplating process if not controlled.

SUMMARY

An electroplating apparatus includes a container containing plural portions and an ionic liquid plating solution that is capable of flowing therebetween. The plural portions include at least a first portion containing a counter electrode that includes coating donor material and a second portion that includes a workpiece. A porous scrubber separating the first and second portions has a plurality of metallic outer surfaces in contact with the ionic liquid plating solution.

A method for coating at least a first surface of a workpiece with a metallic coating includes pretreating a first portion of the workpiece that includes the first surface. The first portion of the workpiece is electrolytically etched in an ionic liquid plating solution to expose at least a portion of the first surface. Etching results in ionic byproducts accumulating in the ionic liquid plating solution. The exposed portion of the first surface is activated, and the metallic coating is electrodeposited onto the exposed portion of the first surface in the ionic liquid plating solution. A portion of the ionic liquid plating solution is fluidly communicated through a porous scrubber having a plurality of metallic outer surfaces in contact with the ionic liquid plating solution, thereby capturing at least some of the accumulated ionic byproducts from the ionic liquid plating solution.

A method of repairing a metallic component includes identifying a location to be repaired on the metallic component. The location is pretreated by performing one or more of: grit blasting, acid etching, desmutting, rinsing, and drying. A first portion of the metallic component is electrolytically etched in an ionic liquid plating solution to expose at least one coating receiving surface proximate to each location. Etching results in accumulation of ionic byproducts in the ionic liquid plating solution. The at least one coating receiving surface is activated and a metallic coating is electrodeposited in the ionic liquid plating solution. At least a portion of the ionic liquid plating solution is fluidly communicated through at least one porous scrubber having a plurality of metallic outer surfaces in contact with the ionic liquid plating solution. The ionic liquid plating solution is regenerated by capturing at least some of the accumulated ionic byproducts from the ionic liquid plating solution.

A method of regenerating an ionic liquid plating solution includes providing a used ionic liquid plating solution. The used ionic liquid plating solution includes at least an ionic liquid and ionic byproducts of at least one electrolytic etching process performed on a metallic workpiece using the ionic liquid. The used ionic liquid plating solution is fluidly communicated through at least one porous scrubber having a plurality of metallic outer surfaces in contact with the used ionic liquid plating solution to capture at least some of the ionic byproducts from the ionic liquid plating solution.

DETAILED DESCRIPTION

A number of metals such as aluminum can be electroplated onto metallic substrates using ionic liquids as the electrolyte as opposed to aqueous solutions. Example plating apparatus and processes utilizing ionic liquids are summarized below. Additional details of example ionic liquid plating processes and possible variations are described in commonly owned U.S. Provisional Patent Applications 61/787,608 to Lei Chen et al., titled "SACRIFICIAL COATING AND PROCEDURE FOR ELECTROPLATING ALUMINUM ON ALUMINUM ALLOYS", and filed on Mar. 15, 2013, and 61/787,640 to Rhonda R. Willigan et al., titled "BIMETALLIC ZINCATING PROCESSING FOR ENHANCED ADHESION OF ALUMINUM ON ALUMINUM ALLOYS", and filed on Mar. 15, 2013, both of which are incorporated herein by reference.

Figure 1A:
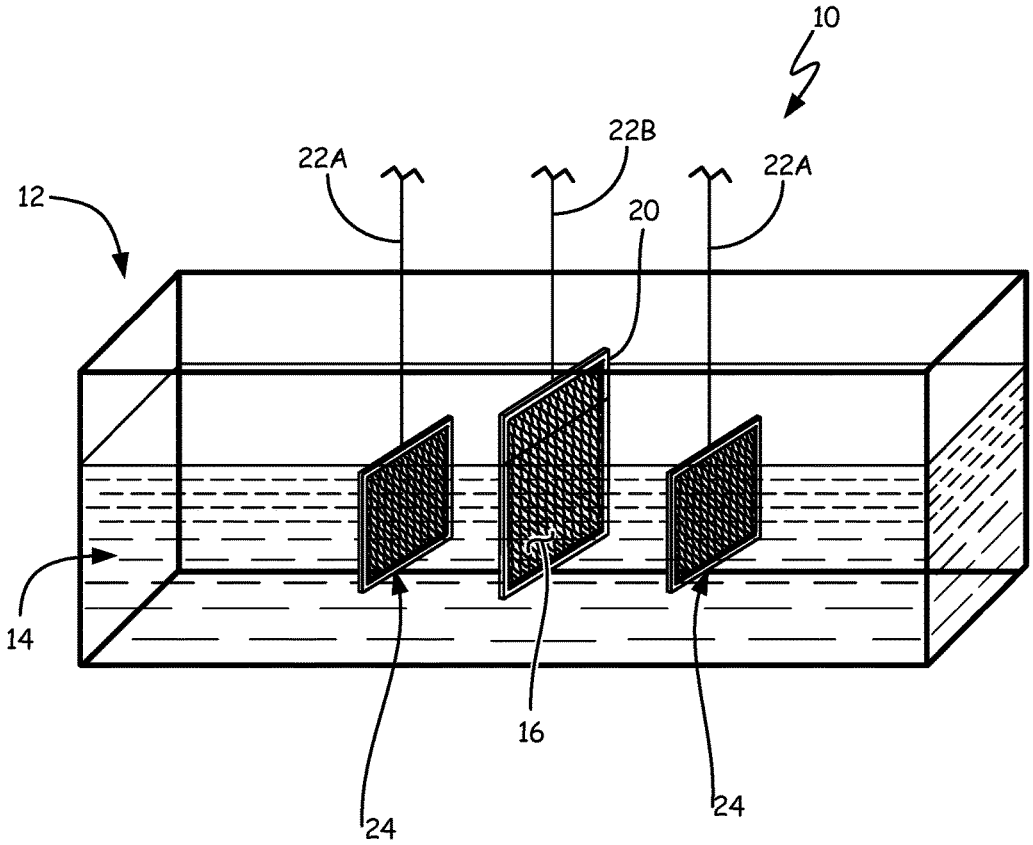
FIG. 1A depicts an example ionic liquid plating apparatus with a workpiece having a metallic substrate and a sacrificial pretreatment layer.

In FIG. 1A, electroplating apparatus 10 includes container 12 which can be any suitable vessel with one or more portions for retaining and flowing ionic liquid plating solution 14 therebetween. Workpiece 20, which can be, for example, a turbine engine component, is first placed in a portion of container 12 and is at least partially submerged in ionic liquid plating solution 14. Workpiece 20 can include a metallic substrate. In certain embodiments the substrate is reactive in the presence of air, and can be, for example, an aluminum or magnesium alloy. In the example of an aluminum alloy substrate, an accepted pretreatment procedure is to clean one or more surfaces of workpiece 20 to remove naturally occurring surface oxides. To summarize, a pretreatment process can include grit blasting, acid etching, desmutting, rinsing, drying and combinations thereof.

To prevent formation of surface oxides after pretreating the substrate, and prior to electrodeposition of a protective metal coating (shown in FIG. 1B), workpiece 20 can be provided with optional displacement layer 16. For workpieces 20 made from more noble metal substrates such as chromium, nickel, molybdenum, iron, and alloys thereof, displacement layer 16 can be omitted when unnecessary to prevent interim formation of surface oxides.

After masking of certain areas, sacrificial displacement layer 16 can be deposited as a thin uniform layer (for example, up to 30 microns) onto aluminum alloy or other reactive metallic substrates by an immersion process. In one example, aluminum and primarily zincate ions react at the workpiece surface, resulting in the reduction of zincate ions to zinc that is bonded to the workpiece surface, as well as liberation of aluminum ions into the solution. To ensure good coverage of displacement layer 16, several iterations of repeated immersion and etching can be conducted. Other metals, such as one or more of tin, copper, zirconium, cerium, if present in solution, may be co-deposited with the zinc resulting in optional displacement layer 16 including zinc, tin, copper, zirconium, cerium, or alloys thereof.

Candidate aluminum alloys for the metallic substrate (workpiece 20 in FIG. 1A) can be any number of high-strength aluminum alloys selected from the AA 6xxx series, the AA 7xxx series, and the AA 2xxx series. Non-limiting examples of candidate aluminum alloys include AA 6061, AA 7075, and AA 2024, among others known or not yet established in the art. Alternatively, the metallic substrate can be a more noble (that is, less reactive) composition which includes copper, chromium, nickel, molybdenum, iron, and alloys thereof.

Figure 1B:
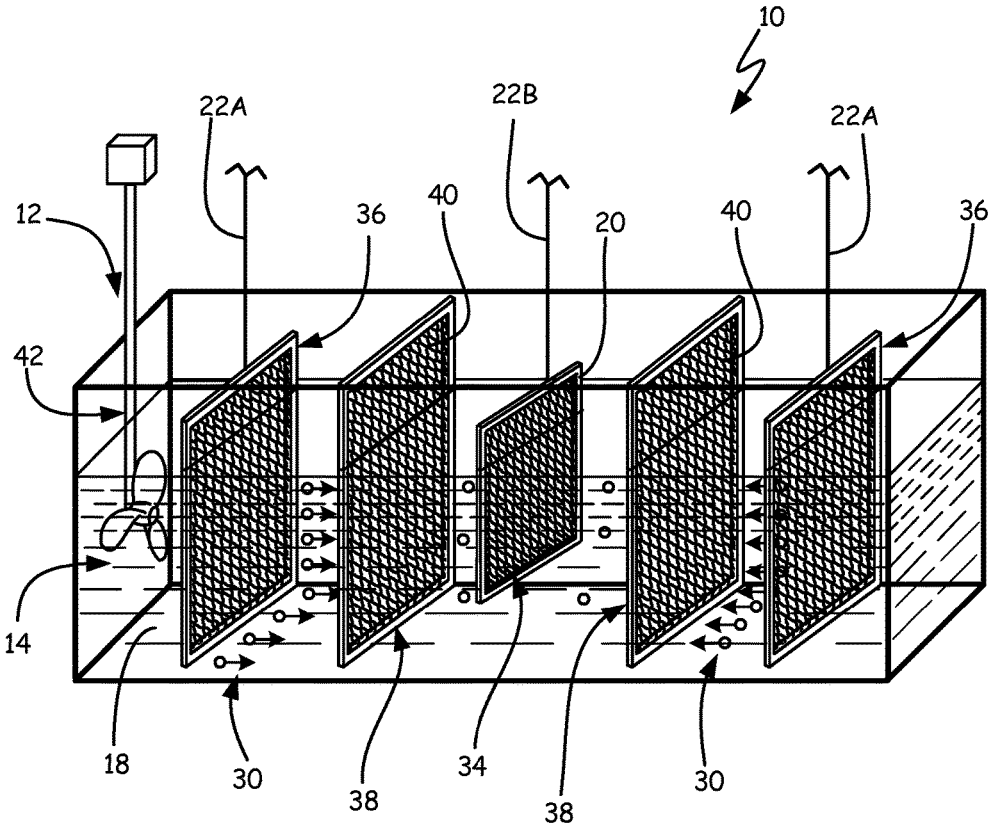
FIG. 1B shows the example ionic liquid plating apparatus applying a protective metallic coating to the workpiece.

As shown in FIG. 1A, apparatus 10 can be operated to partially or completely remove displacement layer 16 in ionic liquid plating solution 14 prior to electroplating of a protective metallic (e.g., aluminum) layer onto workpiece 20 (shown in FIG. 1B). Unlike aqueous electroplating solutions, ionic liquid plating solution 14 does not contain protons or hydroxide to react with elements forming displacement layer 16, and thus displacement layer 16 cannot be spontaneously removed.

Consequently, displacement layer 16 can be partially or fully removed by electrolytic etching in ionic liquid plating solution 14. In one example, workpiece 20 and counter electrodes 24 can be disposed in plural portions of container 12. Workpiece 20 is subjected to an anodic potential (for example, via leads 22A, 22B) which can electrochemically oxidize displacement layer 16 while one or more counter electrodes 24 serve as the cathode. Direct current, pulse current, or pulse reverse current can be used during electrolytic etching. Though the workpiece can be removed after the displacement treatment and transferred to an ionic liquid plating bath dedicated to electrodeposition, it can be useful to conduct the etching and subsequent electrodeposition in the same ionic liquid bath. This can simplify production while minimize undesirable surface changes of coating receiving surface 26, since it reduces or prevents exposure of workpiece 20 to air or other sources of contamination.

Ionic liquid plating solution 14 can include an ionic liquid such as a Lewis acidic di-alkylimidazolium-based chloroaluminate. Examples include but are not limited to: 1-ethyl-3-methylimidazolium chloride [EMIM][Cl]—$AlCl_3$, 1-butyl-3-methylimidizolium chloride [BMIM][Cl]—$AlCl_3$, and combinations thereof. In particular, alkyimidazolium chloroaluminate ionic liquids used for Al electroplating are extremely water sensitive, and thus are not compatible with displacement layer removal by aqueous solutions. Consequently, electrolytic etching in the same ionic liquid plating bath is attractive as an in-situ process to enhance adhesion of a protective aluminum coating layer.

In doing so, over time, ionic byproducts from displacement layer 16 are dissolved and can accumulate in ionic liquid plating solution 14. This results in elevated levels of those species that deteriorate the Al coating quality, otherwise necessitating replacement of the plating solution. Besides reactive substrates, "reverse" etching can be applied to more noble metals such as steels prior to electroplating aluminum to improve adhesion. Similar to etching of displacement layer 16, materials which are etched off of these more noble substrates can also result in accumulation of ionic byproducts which contaminate ionic liquid plating solution 14.

While those ionic byproducts can be reduced using an active anode such as an aluminum counter electrode, an active anode is often insufficient to remove the amount of contaminants accumulated in the plating bath, particularly over the course of multiple plating cycles. Deposition of these contaminants can also hinder dissolution of the Al coating from the anode because of the tendency of the process to equilibrate in order to maintain the mass balance of aluminum in the solution. In addition, the use of relatively expensive ionic liquids in aluminum electroplating also calls for techniques to recycle and regenerate the plating solution. Therefore, it would be helpful to effectively remove contaminants from ionic liquid plating solution 14 to maintain the quality and repeatability of aluminum electroplating processes.

FIG. 1B shows apparatus 10 in a plating configuration for depositing protective metal coating 34 onto workpiece 20. Apparatus 10 includes one or more porous scrubbers 38 disposed in plural portions of container 12 between workpiece 20 and counter electrode (anode during plating) 36. Ionic liquid plating solution 14 is fluidly communicated through scrubber(s) 38 to remove at least some of the ionic byproducts 30. This in-situ regeneration can extend the life of ionic liquid plating solution 14 and increase process yields.

Electrolytically removing materials such as sacrificial displacement layer 16 from workpiece(s) 20 can result in accumulation of ionic byproducts 30 (enlarged for illustration only) in ionic liquid plating solution 14. Ionic byproducts 30 which may be present can include but are not limited to ionic species of zinc, tin, copper, iron, nickel, chromium, etc. These impurities can contaminate coating receiving surface 26, as well as counter electrode (anode) 36. Since aluminum and magnesium are more active than many ionic byproduct species, the contamination reaction is often spontaneous. Repeated iterations of this process, such as in a pilot or production environment, would ordinarily require frequent changing of expensive ionic liquid plating solution 14 and/or reduced electroplating process yields.

Despite the absence of displacement layer 16 on more noble metal substrates such as steels, aluminum plating can benefit from similar electrolytic etching processing prior to electroplating. In iron alloys, chromium, nickel, vanadium, molybdenum, etc, can also be etched off the substrate and ionized in the same plating bath. This also causes similar buildup of ionic byproducts 30 in ionic liquid plating solution 14 and cause contamination of coating receiving surface 26 and/or counter electrode (anode) 36.

Figure 2:
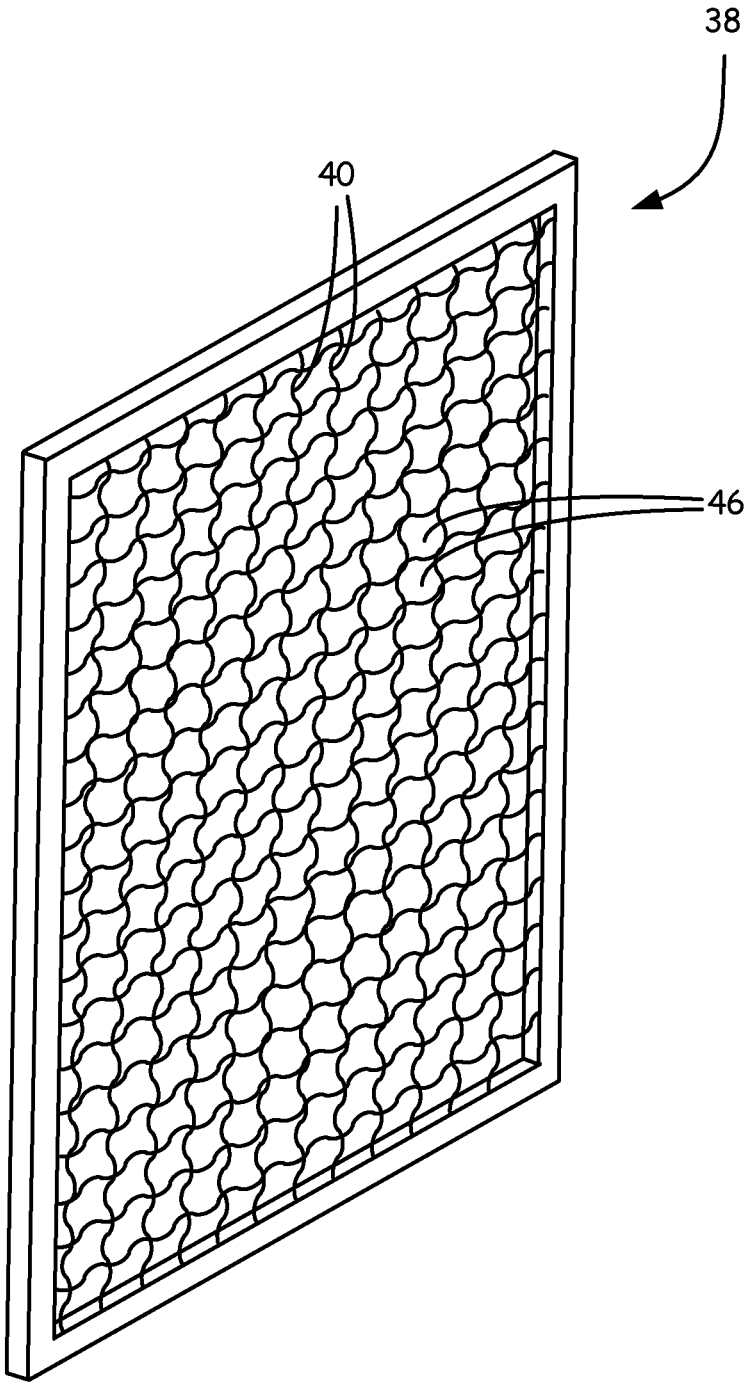
FIG. 2 shows a porous scrubber for the example plating apparatus in FIGS. 1A-1B.

FIG. 1B shows scrubbers 38 which may also have a plurality of metallic outer surfaces 40 (best seen in FIG. 2). Metallic outer surfaces 40 can include substantially pure aluminum, the same material as can be used for counter electrodes 36. Aluminum or other scrubbers 38, taking various forms, can be added to container 12 so as to at least partially separate plural portions of container 12 containing one or more counter electrodes 36 and one or more workpieces 20. Scrubber(s) 38 can be submerged so that at least some of metallic outer surfaces 40 are in contact with ionic liquid plating solution 14 as it is fluidly communicated therethrough. As an example, porous scrubber(s) 38 can be placed between plural portions of container 12 on either side of workpiece 20 to capture ionic byproducts 30, as these and other contaminants are transported in ionic liquid plating solution 14. The contaminants generally move by convection of the fluid and/or migration under electrical field.

Porous scrubber 38 can be disposed between the anode (counter electrode 36) and the cathode (workpiece 20) to remove excess ionic byproducts 30 as they are shuttled back and forth. Scrubber 38 can also be periodically replaced without unduly slowing a production environment, as it can be replaced at the same time as workpiece 20 and/or counter electrode(s) 36.

As an example, metallic outer surfaces 40 of porous scrubber 38 can be made of aluminum. On contact with porous scrubber 38, any ionic species that are more noble than aluminum are reduced and collected on outer surfaces 40 when enough active area is available, making them unavailable to be shuttled around and redeposited on counter electrode 36 or workpiece 20. In the absence of scrubber(s) 38, ionic byproducts generated by electrolytic etching of the substrates and/or residual contamination from pretreatment of workpieces 20 accumulate in plating solution 14. This would cause rapid buildup of impurities on workpiece 20 and/or active counter electrode 36.

In certain embodiments, one or more optional agitators 42 is adapted to mechanically circulate ionic liquid plating solution 14 through container 12, and more particularly, in and around porous scrubber 38. Agitator(s) 42 can be, for example, a mechanically or magnetically actuated agitator, impeller, or other suitable device. Application of plating current is such that it causes ionic species of both coating donor material (anode) 36 as well as byproducts of the sacrificial coating layer to shuttle toward workpiece (cathode) 20 during the plating process. Thus even without optional agitator(s) 42, a portion of excess zincate byproducts can be picked up as ionic liquid plating solution 14 flows past and through scrubber 38.

FIG. 2 shows one example of porous scrubber 38. Ionic liquid plating solution 14 is fluidly communicated through pores 46 while contaminant ions and/or other byproducts are attracted to metallic surfaces 40 of scrubber 38. Alternatively, scrubber 38 can be biased to an even more active electric potential to accelerate the contaminant removing process.

Scrubber 38 is shown as a mesh screen with metallic surfaces 40 and pores 46. However, it will be appreciated that the configuration of scrubber 38 can be selected from many porous media, including one or more of: a mesh, foam, a honeycomb, a powder bed, and a fluidized bed. Metallic surfaces 40 can be made from a material which is capable of reducing the ionic byproducts. Outer metallic surfaces can include a metal selected from substantially pure aluminum or substantially pure magnesium.

Figure 3:
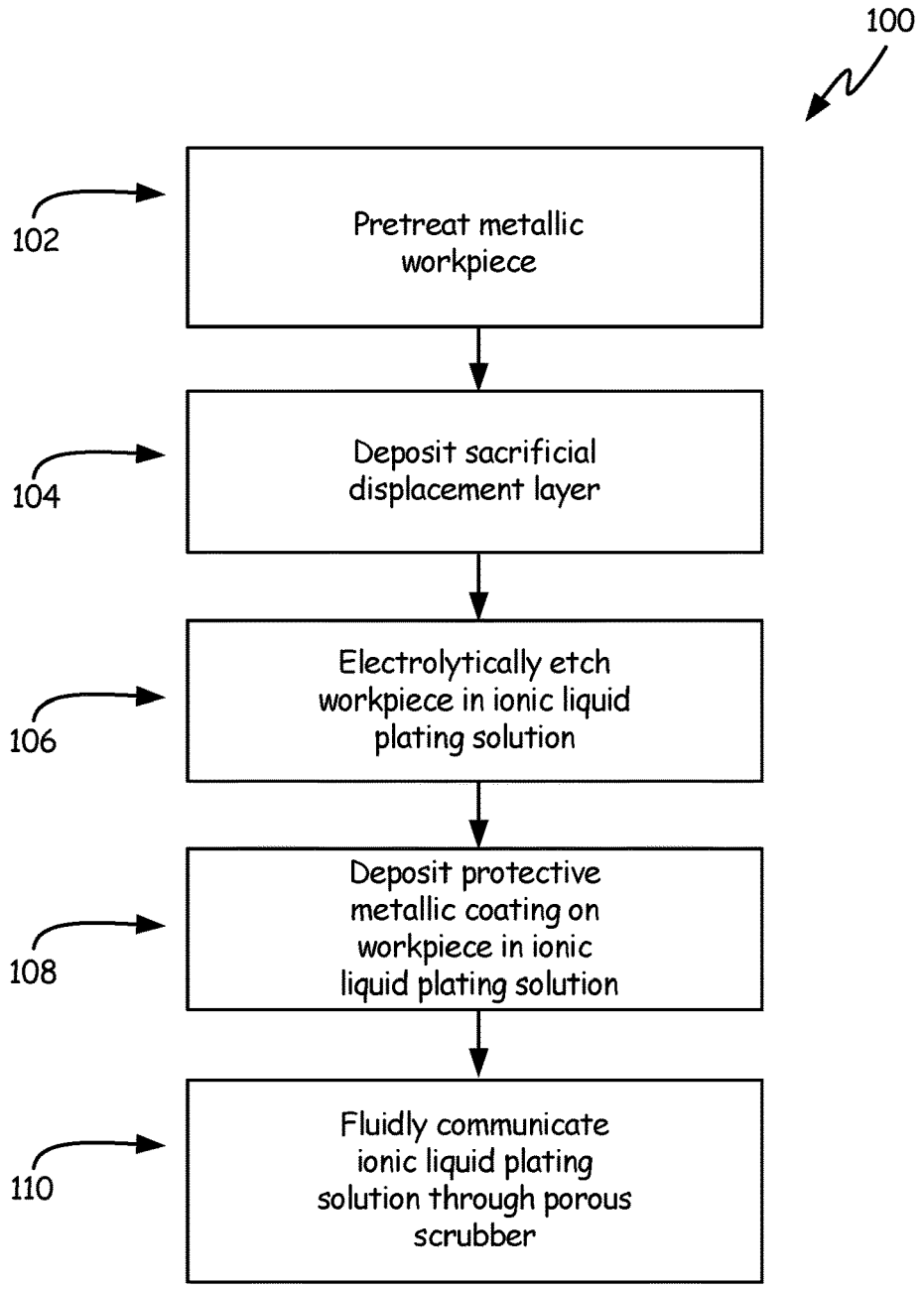
FIG. 3 is a chart showing an example ionic liquid plating process with in situ regeneration of the plating solution.

FIG. 3 illustrates method 100 of coating at least one surface of a workpiece with a metallic coating. The metallic coating can be applied, for example, using embodiments of apparatus 10 shown in FIGS. 1A and 1B. Step 102 includes pretreating a first portion of the workpiece, which includes the surface(s) to be coated. The pretreating process can include one or more of grit blasting, acid etching, desmutting, rinsing, and drying.

Method 100 includes optional step 104 of depositing a sacrificial displacement layer onto a portion of a workpiece prior to electrolytic etching (step 106) and/or electrodeposition (step 108) in an ionic liquid plating solution. Performing of step 104 is generally determined based on reactivity of the metallic substrate. Workpieces with more reactive substrates such as aluminum and magnesium alloys will generally receive one or more iterations of step 104 so as to prevent spontaneous formation of surface oxides prior to adding the workpiece to the ionic liquid plating solution to perform steps 106 and 108.

Depositing step 104 can include, for example, an immersion process as described above with respect to FIG. 1A. The displacement layer can be formed from a metal selected from: zinc, tin, copper, zirconium, cerium, and alloys thereof. The workpiece can include a metallic substrate selected from: aluminum, chromium, nickel, iron, and alloys thereof. Candidate aluminum alloys, which can be a high-strength aluminum alloy selected from the 6xxx, 7xxx, and 2xxx series, include but are not limited to AA 6061, AA 7075, AA 2024, as well as others known or not yet established in the art. For more noble substrates such as steels, the displacement layer treatment of step 104 can be shortened or omitted.

Step 106 can then include electrolytic etching one or more portions of the workpiece in an ionic liquid plating solution. The ionic liquid plating solution can include an ionic liquid solvent such as a Lewis acidic di-alkylimidazolium-based chloroaluminate. Examples include but are not limited to: 1-ethyl-3-methylimidazolium chloride [EMIM][C1]—$AlCl_3$, 1-butyl-3-methylimidizolium chloride [BMIM][Cl]—$AlCl_3$, and combinations thereof.

At least a portion of the workpiece, with or without the optional displacement layer, is electrolytically removed to expose a more active surface for subsequent electrodeposition in the ionic liquid plating solution (see step 108). In the case of highly reactive aluminum or magnesium alloys, electrolytic etching may be sufficient to activate exposed substrate surface(s) upon application of a suitable electroplating current. Even without the optional displacement layer, in-situ "reverse" etching and subsequent activation of the exposed portions of the substrate surface (as part of step 106) can enhance adhesion of electrodeposited coatings to more noble substrates.

Next as part of step 108, a protective metallic coating (for example, substantially pure aluminum) can be electrodeposited onto the coating receiving surface of the workpiece. To enhance efficiency and prevent infiltration of water or certain other contaminants, the electrodepositing step can be performed with the exposed portions of the substrate surface submerged in the same ionic liquid plating solution as is referenced in step 106. Various processes for electrodeposition using ionic liquid plating solutions are described in the incorporated applications referenced above.

During or after step 108, step 110 is performed in which at least a portion of the ionic liquid plating solution can be fluidly communicated through a porous scrubber to capture or remove at least some of the accumulated ionic byproducts from the plating solution. The scrubber can be, for example, similar to porous scrubber 38 shown in FIG. 2. An in situ scrubbing configuration can be incorporated such as is referenced in FIG. 1. Outer scrubber surfaces can include a substantially pure metal such as aluminum and/or magnesium.

Figure 4:
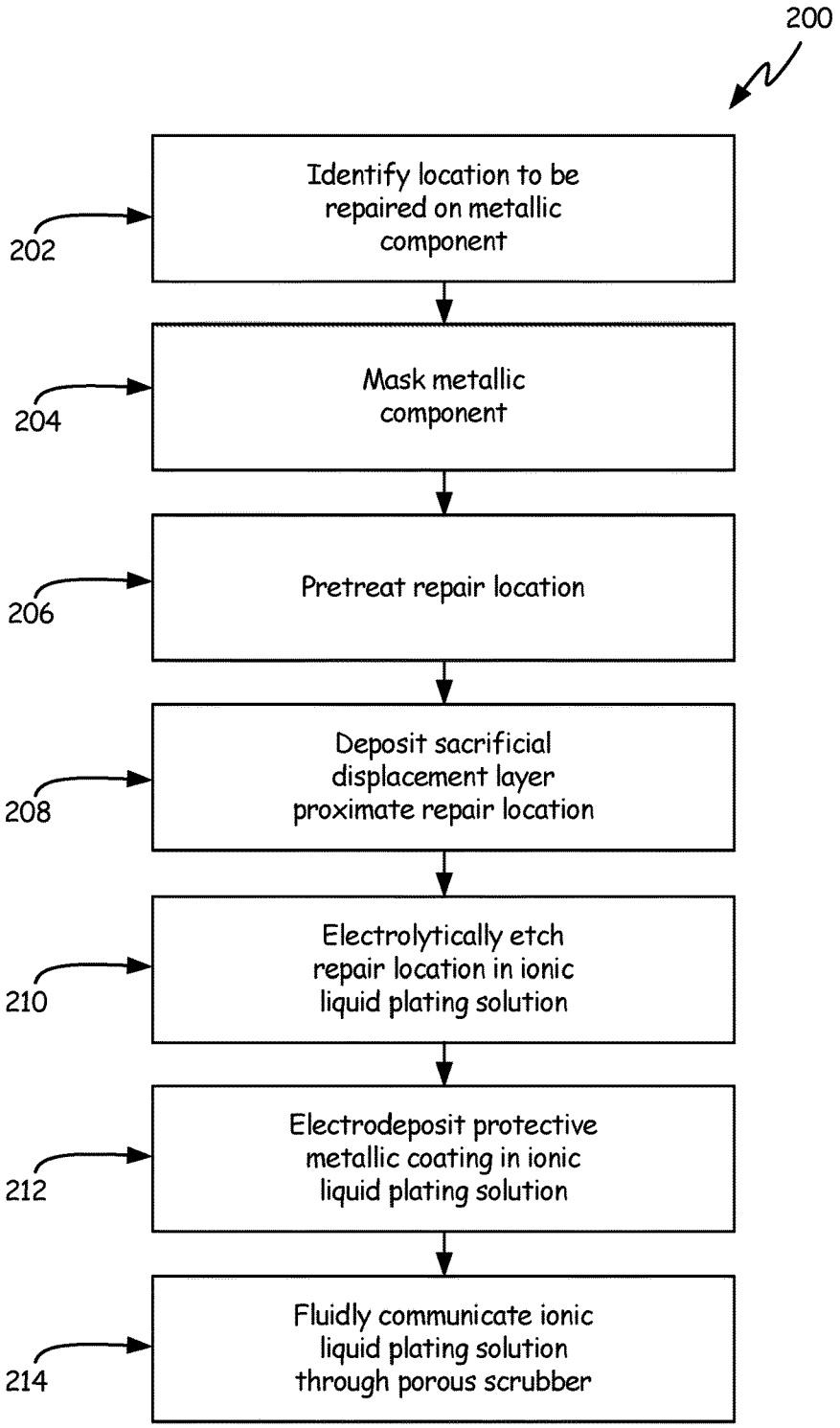
FIG. 4 is a chart showing an example ionic liquid plating process with periodic regeneration of an ionic liquid plating solution used in the plating process.

FIG. 4 shows method 200 of repairing one or more metallic components. In certain embodiments, the metallic component(s) can include a turbine engine component which may be restored on one or more surfaces by a metal coating such as substantially pure aluminum. The turbine engine component(s) can be, for example, a rotor blade, a stator vane, a rotor disk, and/or a stator case for turbine engines.

In FIG. 4, step 202 lists identifying a location to be repaired on the metallic component(s). As in FIG. 3, the metallic component has a metallic substrate selected from aluminum, nickel, magnesium, chromium, molybdenum, iron, and alloys thereof. Candidate aluminum alloys can be selected from high-strength alloys in the 6xxx series, the 7xxx series, and the 2xxx series, and include but are not limited to AA 6061, AA 7075, AA 2024, as well as others known or not yet established in the art.

Step 204 involves masking areas of each component other than those surfaces or locations which will be repaired or coated. Masked areas can include one or more undamaged or previously repaired areas of the component. Masking step 204 is optional where the entirety of the component is to be repaired, restored, and/or coated. Step 206 includes pretreating the workpiece(s), including at least the portions of the workpiece to be coated or repaired. Like step 102 in FIG. 3, the pretreatment process can include one or more of grit blasting, acid etching, desmutting, rinsing, and drying.

At step 208, similar to step 104 in FIG. 3, a sacrificial displacement layer can be optionally deposited onto a portion of each metallic component substrate proximate to each location to be repaired. As noted above, reactive substrates such as aluminum and magnesium alloys can receive this treatment.

Next, step 210 includes electrolytically etching at least a portion of the component(s) to be repaired in an ionic liquid plating solution. Etching step 210 is generally similar to step 106, shown and described with respect to FIG. 3. In the case of more noble substrates, the pretreatment process of step 202 generally exposes the majority of relevant coating receiving surfaces while "reverse" etching of the surfaces to be coated as part of step 210 can result in improved adhesion of protective coatings electrodeposited in step 212.

And in the case of more reactive aluminum- and magnesium-based substrates, step 210 may include electrolytically etching at least a portion of the optional sacrificial pretreatment layer previously deposited as part of step 208. In the case of highly reactive aluminum or magnesium alloy substrates, electrolytic etching may be sufficient to activate exposed surface(s) upon application of a suitable electroplating current. Regardless of the reactivity of the substrate, exposing coating receiving surface(s) via etching step 208 can generate ionic byproducts from the workpiece, as well as ionic byproducts of any optional displacement layers. These byproducts and other contaminants can accumulate in the ionic liquid plating solution.

Step 212 involves electrodepositing a protective coating, such as substantially pure aluminum, onto the coating receiving surface(s). The protective coating is electrodeposited by applying a current through the ionic liquid plating solution as described above. Finally, step 214 includes periodically regenerating the ionic liquid plating solution by fluidly communicating the ionic liquid plating solution through at least one porous scrubber. The porous scrubber(s) have a metallic outer surface adapted to capture at least some of the ionic byproducts dissolved in the plating solution. The porous scrubber(s) may be periodically introduced into the plating vessel during etching step 208 and/or electrodepositing step 210. Alternatively, the porous scrubber(s) can be used in a separate vessel to periodically regenerate bulk volumes of ionic liquid plating solution after one or more iterations of steps 202-212.

As described with respect to apparatus 10 in FIGS. 1A-1B, repeated electrolytic etching can cause a buildup of ionic byproducts in the ionic liquid plating solution. Thus step 214 can be performed simultaneously with step 212 in which a protective coating is electrodeposited onto each metallic component.

Alternatively, a used ionic liquid plating solution containing ionic byproducts of at least one electrolytic etching process can be regenerated according to a method similar to step 214. The method can use, for example, a separate fluid regeneration circuit (not shown) with at least one porous scrubber disposed in the circuit. The used ionic liquid plating solution can be fluidly communicated through the porous scrubber(s) having a plurality of metallic outer surfaces in contact with the used ionic liquid plating solution. This captures at least some of the ionic byproducts from the ionic liquid plating solution, extending its useful life and/or reducing disposal costs.

Discussion of Possible Embodiments

The following are non-exclusive descriptions of possible embodiments of the present invention.

An electroplating apparatus includes a container containing plural portions and an ionic liquid plating solution that is capable of flowing therebetween. The plural portions include at least a first portion containing a counter electrode that includes coating donor material and a second portion that includes a workpiece.

The apparatus of the preceding paragraph can optionally include, additionally and/or alternatively, any one or more of the following features, configurations and/or additional components:

The electroplating apparatus, according to an exemplary embodiment of this disclosure, among other possible things includes a porous scrubber separating the first and second portions has a plurality of metallic outer surfaces in contact with the ionic liquid plating solution.

A further embodiment of the foregoing apparatus, wherein the workpiece comprises a metallic component substrate selected from the group consisting of: aluminum, magnesium, chromium, nickel, molybdenum, iron, and alloys thereof.

A further embodiment of any of the foregoing apparatus, wherein the metallic component substrate is an aluminum alloy selected from the group consisting of: AA 6xxx series alloys, AA 7xxx series alloys, and AA 2xxx alloys.

A further embodiment of any of the foregoing apparatus, wherein the workpiece comprises a turbine engine component.

A further embodiment of any of the foregoing apparatus, wherein the metallic component substrate is selected from the group consisting of: an AA 6061 alloy, an AA 7075 alloy, and an AA 2024 alloy.

A further embodiment of any of the foregoing apparatus, wherein the workpiece comprises an outer displacement layer.

A further embodiment of any of the foregoing apparatus, wherein the outer displacement layer comprises a metal selected from: zinc, tin, copper, zirconium, cerium, and alloys thereof.

A further embodiment of any of the foregoing apparatus, wherein the ionic liquid plating solution contains ionic byproducts of the outer displacement layer.

A further embodiment of any of the foregoing apparatus, wherein the ionic liquid plating solution comprises an ionic liquid selected from: 1-ethyl-3-methylimidazolium chloride [EMIM][Cl]—$AlCl_3$, 1-butyl-3-methylimidizolium chloride [BMIM][Cl]—$AlCl_3$, and combinations thereof.

A further embodiment of any of the foregoing apparatus, wherein the coating donor material comprises substantially pure aluminum.

A further embodiment of any of the foregoing apparatus, wherein the porous scrubber comprises a metallic outer surface selected from: substantially pure aluminum or substantially pure magnesium.

A further embodiment of any of the foregoing apparatus, further comprising an agitator adapted to circulate the ionic liquid plating solution through the porous scrubber.

A method for coating at least a first surface of a workpiece with a metallic coating includes pretreating a first portion of the workpiece that includes the first surface. The first portion of the workpiece is electrolytically etched in an ionic liquid plating solution to expose at least a portion of the first surface. Etching results in ionic byproducts accumulating in the ionic liquid plating solution. The exposed portion of the first surface is activated, and the metallic coating is electrodeposited onto the exposed portion of the first surface in the ionic liquid plating solution. A portion of the ionic liquid plating solution is fluidly communicated through a porous scrubber having a plurality of metallic outer surfaces in contact with the ionic liquid plating solution, thereby capturing at least some of the accumulated ionic byproducts from the ionic liquid plating solution.

The method of the preceding paragraph can optionally include, additionally and/or alternatively, any one or more of the following features, configurations and/or additional components:

The method, according to an exemplary embodiment of this disclosure, among other possible things includes pretreating a first portion of the workpiece that includes the first surface; electrolytically etching the first portion of the workpiece in an ionic liquid plating solution to expose at least a portion of the first surface, the etching step resulting in ionic byproducts accumulating in the ionic liquid plating solution; activating the exposed portion of the first surface; electrodepositing the metallic coating onto the exposed portion of the first surface in the ionic liquid plating solution; and fluidly communicating a portion of the ionic liquid plating solution through a porous scrubber, the scrubber having a plurality of metallic outer surfaces in contact with the ionic liquid plating solution to capture at least some of the accumulated ionic byproducts from the ionic liquid plating solution.

A further embodiment of the foregoing method, wherein the pretreating step comprises one or more of grit blasting, acid etching, desmutting, rinsing, and drying.

A further embodiment of any of the foregoing methods, wherein the workpiece comprises a metallic component substrate selected from the group consisting of: aluminum, magnesium, chromium, nickel, molybdenum, iron, and alloys thereof.

A further embodiment of any of the foregoing methods, wherein the electrolytically etching step is performed using the same ionic liquid plating solution as is used in the electrodepositing step.

A further embodiment of any of the foregoing methods, further comprising depositing a displacement layer onto a portion of a workpiece prior to the electrolytically etching step.

A further embodiment of any of the foregoing methods, wherein the electrolytically etching step comprises electrolytically removing at least a portion of the displacement layer to expose the portion of the first surface.

A further embodiment of any of the foregoing methods, wherein the displacement layer comprises a metal selected from the group consisting of: zinc, tin, copper, zirconium, cerium, and alloys thereof.

A further embodiment of any of the foregoing methods, wherein the depositing step comprises an immersion process including a zincating process.

A further embodiment of any of the foregoing methods, wherein the protective metallic coating comprises a substantially pure metal selected from the group consisting of: aluminum and magnesium.

A further embodiment of any of the foregoing methods, wherein a configuration of the porous scrubber is selected from one or more of: a mesh, a foam, a honeycomb, a powder bed, and a fluidized bed.

A method of repairing a metallic component includes identifying a location to be repaired on the metallic component. The location is pretreated by performing one or more of: grit blasting, acid etching, desmutting, rinsing, and drying. A first portion of the metallic component is electrolytically etched in an ionic liquid plating solution to expose at least one coating receiving surface proximate to each location. Etching results in accumulation of ionic byproducts in the ionic liquid plating solution. The at least one coating receiving surface is activated and a metallic coating is electrodeposited in the ionic liquid plating solution. At least a portion of the ionic liquid plating solution is fluidly communicated through at least one porous scrubber having a plurality of metallic outer surfaces in contact with the ionic liquid plating solution. The ionic liquid plating solution is regenerated by capturing at least some of the accumulated ionic byproducts from the ionic liquid plating solution.

The method of the preceding paragraph can optionally include, additionally and/or alternatively, any one or more of the following features, configurations and/or additional components:

The method, according to an exemplary embodiment of this disclosure, among other possible things includes identifying a location to be repaired on the metallic component; pretreating the location by performing one or more of: grit blasting, acid etching, desmutting, rinsing, and drying; electrolytically etching a first portion of the metallic component in an ionic liquid plating solution to expose at least one coating receiving surface proximate to each location, the etching step resulting in accumulation of ionic byproducts in the ionic liquid plating solution; activating the at least one coating receiving surface; electrodepositing a metallic coating on the at least one coating receiving surface in the ionic liquid plating solution; and fluidly communicating at least a portion of the ionic liquid plating solution through at least one porous scrubber, the scrubber having a plurality of metallic outer surfaces in contact with the ionic liquid plating solution to regenerate the ionic liquid plating solution by capturing at least some of the accumulated ionic byproducts from the ionic liquid plating solution.

A further embodiment of the foregoing method, further comprising masking at least one undamaged area of the component prior to the electrolytically etching step.

A further embodiment of any of the foregoing methods, further comprising depositing a displacement layer onto a portion of the metallic component proximate to the location to be repaired.

A further embodiment of any of the foregoing methods, wherein the electrolytically etching step comprises electrolytically etching at least a portion of the displacement layer from the metallic component.

A further embodiment of any of the foregoing methods, wherein the metallic component is a turbine engine component.

A further embodiment of any of the foregoing methods, wherein the turbine engine component is a rotor blade, a stator vane, a rotor disk, or a stator case.

A further embodiment of any of the foregoing methods, wherein repairing the plurality of metallic components includes restoring at least one surface of the turbine engine component.

Although the present invention has been described with reference to preferred embodiments, workers skilled in the art will recognize that changes may be made in form and detail without departing from the spirit and scope of the invention.

The invention claimed is:

1. A method for coating at least a first surface of a workpiece with a metallic coating, the method comprising:

electrolytically etching a first portion of the workpiece in a container holding an ionic liquid plating solution, the etching step comprising subjecting the workpiece to an anodic potential and subjecting a counter electrode to a cathodic potential to remove at least a portion of an applied displacement layer, thereby (i) accumulating ionic byproducts of the removed portion of the displacement layer in the ionic liquid plating solution in the container and (ii) exposing and activating the first surface;

electrodepositing the metallic coating onto the exposed and activated portion of the first surface without removing the workpiece from the container or the ionic liquid plating solution, the electrodepositing step comprising subjecting the counter electrode to an anodic potential and subjecting the workpiece to a cathodic potential to deposit coating donor material from the counter electrode onto the surface to be coated; and during at least one of the etching step and the electrodepositing step, fluidly communicating a portion of the ionic liquid plating solution through a porous scrubber disposed in the ionic liquid plating solution in the container between the workpiece and the counter electrode, the scrubber having a plurality of metallic outer surfaces in contact with the ionic liquid plating solution to capture at least some of the accumulated ionic byproducts of the removed portion of the displacement layer from the ionic liquid plating solution;

wherein a portion of the ionic byproducts adhere to the metallic outer surfaces of the scrubber during at least the etching mode, thereby regenerating the ionic liquid plating solution in situ by removing at least a portion of the ionic byproducts therefrom without removing the ionic liquid plating solution from the container.

2. The method of claim 1, further comprising:

pretreating a first portion of the workpiece that includes the first surface;

prior to the electrolytically etching step, depositing the displacement layer onto at least the pretreated first portion of the workpiece.

3. The method of claim 1, wherein the workpiece comprises a metallic component substrate selected from the group consisting of: aluminum, magnesium, chromium, nickel, molybdenum, iron, and alloys thereof.

4. The method of claim 2, wherein the pretreating step comprises:

one or more of grit blasting, acid etching, desmutting, rinsing, and drying.

5. The method of claim 2, wherein the displacement layer comprises a metal selected from a group consisting of: zinc, tin, copper, zirconium, cerium, and alloys thereof.

6. The method of claim 5, wherein the depositing step comprises:

an immersion process including a zincating process.

7. The method of claim 1, wherein the metallic coating comprises a substantially pure metal selected from the group consisting of: aluminum and magnesium.

8. The method of claim 3, wherein the metallic component substrate comprises an aluminum alloy selected from the group consisting of: AA 6061 alloy, AA 7075 alloy, and AA 2024 alloy.

9. The method of claim 1, wherein the workpiece comprises a turbine engine component.

10. The method of claim 1, wherein the ionic liquid plating solution comprises an ionic liquid selected from: 1-ethyl-3-methylimidazolium chloride [EMIM][Cl]-$AlCl_3$, 1-butyl-3-methylimidizolium chloride [BMIM][Cl]-$AlCl_3$, and combinations thereof.

11. The method of claim 1, further comprising:

electrically biasing the porous scrubber at least during the etching step.

12. The method of claim 1, further comprising:

electrically biasing the porous scrubber at least during the electroplating step.

13. The method of claim 1, further comprising:

operating at least one agitator in the container, the agitator adapted to circulate the ionic liquid plating solution through the porous scrubber.

14. The method of claim 1, wherein a configuration of the porous scrubber is selected from a group consisting of: a mesh, foam, a honeycomb, a powder bed, and a fluidized bed, and combinations thereof.

* * * * *